US005921216A

United States Patent [19]

Ballman et al.

[11] Patent Number: 5,921,216

[45] Date of Patent: Jul. 13, 1999

[54] INTERNAL COMBUSTION ENGINE

[75] Inventors: Rainer Ballman, Malbergweich; Christian Ederle, Baltmannsweiler; Kurt Maute, Sindelfingen; Guido Vent, Speyer; Jürgen Willand, Stuttgart; Klaus Wunderlich, Waiblingen, all of Germany

[73] Assignee: Daimler-Benz AG, Stuttgart, Germany

[21] Appl. No.: 09/080,477

[22] Filed: May 18, 1998

[51] Int. Cl.[6] ..... F02D 13/04

[52] U.S. Cl. ..... 123/321; 123/322

[58] Field of Search ..... 123/321, 322

[56] References Cited

U.S. PATENT DOCUMENTS

| | | | |
|---|---|---|---|
| 5,088,460 | 2/1992 | Echeverria | 123/321 |
| 5,117,790 | 6/1992 | Clarke et al. | 123/321 |
| 5,404,851 | 4/1995 | Neitz et al. | 123/322 |
| 5,526,784 | 6/1996 | Hakkenberg et al. | 123/322 |
| 5,647,318 | 7/1997 | Feucht et al. | 123/321 |
| 5,680,841 | 10/1997 | Hu | 123/321 |
| 5,733,219 | 3/1998 | Rettig et al. | 123/322 |

FOREIGN PATENT DOCUMENTS

| | | |
|---|---|---|
| 3428627 | 2/1986 | Germany . |
| 4236009 A 1 | 4/1994 | Germany . |

*Primary Examiner*—Erick R. Solis
*Attorney, Agent, or Firm*—Klaus J. Bach

[57] ABSTRACT

In an internal combustion engine for motor vehicles with an engine shutdown driven capability, wherein the engine has intake and exhaust valves with a variable timing valve actuating system permitting the generation of an engine braking torque depending on the state of vehicle operation, the intake and exhaust valves are controlled during shutdown engine driven operation such that at least on type of valves, that is either all the intake or all the exhaust valves remain closed.

8 Claims, 2 Drawing Sheets

INTERNAL COMBUSTION ENGINE

BACKGROUND OF THE INVENTION

The invention resides in an internal combustion engine for motor vehicles wherein the engine intake and exhaust valves are controlled so as to provide a certain motor braking torque depending on the vehicle operating state.

Vehicle operation without engine power may be based on two opposite objectives. In one case, the engine should generate the smallest possible motor braking torque such that the vehicle can move as far as possible without requiring engine power or it may be necessary for the engine to generate a braking torque in order to provide braking forces on downhill slopes, for example.

These objects are achieved by an internal combustion engine as described in the assignees German patent publication DE 34 28 627 A1. The engine braking torque is controllable by an exhaust gas throttle valve which is arranged in the engine exhaust duct and which causes an exhaust gas backup depending on the position of the valve. Each of the gas exhaust valves includes a limit structure which prevents the valves from fully closing. The exhaust valves are closed only to such an extent that a certain braking effect is achieved. The limit structure and the throttle valves are controllable by a brake pedal position dependent adjustable control valve.

In another procedure, DE 42 36 009 A1 discloses a method wherein the air mass flow through the internal combustion engine is controllable depending on a certain vehicle operating state and independently of a fuel volume flow in order to control the engine braking torque. During operation of the engine without power, a very small engine braking moment can be achieved when engine braking is switched off, while the throttle valve on the intake side is open. If a high engine braking torque is desired, the throttle valve and possibly also an idle air bypass are fully closed.

Furthermore, with an internal combustion engine with selectable valve opening and closing times that is for example with hydraulically or electromagnetically operated gas change valves, a very low engine braking torque can be achieved when all the gas change valves are kept constantly closed. When a high engine braking torque is desired, the gas change valves are all closed during the engine intake stroke and are shortly opened when the pistons reach their lower dead center positions in order to fill the combustion chamber with air whereupon all the valves are again closed in order to cause the air to be compressed by the piston. At the upper dead center, all the valves are then shortly opened whereby the gas is discharged and, with the valves again closed, the piston needs to generate expansion work already in the next stroke in which it moves from the top to the bottom dead center. Such procedures however generate relatively high emissions as there is a relatively high gas flow volume through the engine which furthermore may cool the catalytic converters to such a degree that they are no longer fully effective in converting the contaminants.

It is the object of the present invention to improve the emissions of such an engine and to reduce the chances that a catalytic converter is excessively cooled down during such a procedure.

SUMMARY OF THE INVENTION

In an internal combustion engine for motor vehicles with an engine shutdown driven capability, wherein the engine has intake and exhaust valves with a variable timing valve actuating system permitting the generation of an engine braking torque depending on the state of vehicle operation, the intake and exhaust valves are controlled during shutdown engine driven operation such that at least one type of valves, that is either all the intake or all the exhaust valves remain closed.

The invention is based on the recognition that fuel reaches the walls of the intake duct and forms a film on the walls. This film is gradually removed as the air passes over the film during operation of the engine without power that is without fuel supply to the air. The fuel dislodged from the walls is carried by the air through the engine and into the exhaust system. This results in an increase of the hydrocarbon concentration in the air which increases engine emissions. By keeping the intake and exhaust valves closed during engine operation without power, air flow through the engine is stopped so that the unburned hydrocarbon content discharged to the environment is not increased. In addition, no fresh air is conducted through the catalytic converter so that the catalytic converter remains hot and furthermore is not subjected to oxygen which may have a detrimental effect on the catalytic converter.

Further features of the invention and the advantages resulting therefrom will become apparent from the following description of a particular embodiment.

In the description and in the claims, numerous features are represented and described in combination. The person skilled in the art will consider particular features on their merits and suitably combine the features.

DESCRIPTION OF A PREFERRED EMBODIMENT

Figure 1:
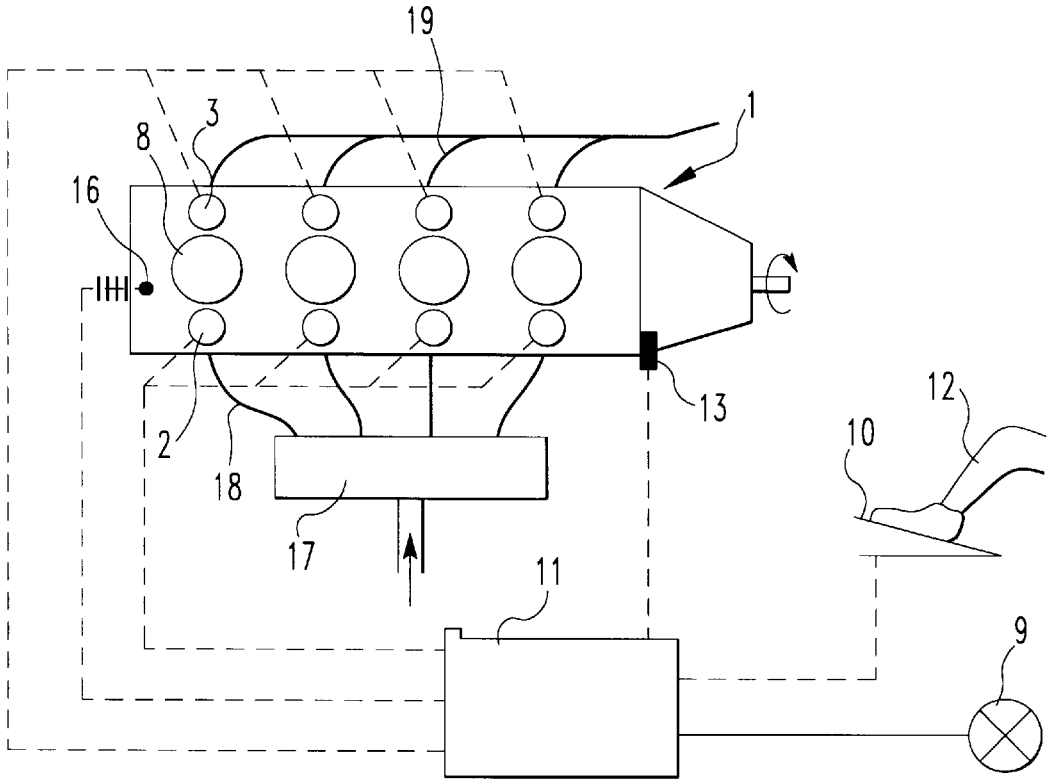
FIG. 1 shows an arrangement for the control of an internal combustion engine in principle.

FIG. 1 shows an internal combustion engine 1 with four cylinders 8, which take in a fuel/air mixture from an air distribution pipe 17 by way of intake ducts 8 and gas intake valves 2 and discharge exhaust gases by way of gas exhaust valves 3 and exhaust gas pipes 18. The engine may include a plurality of cylinders 8 each having more than 1 intake valve 2 and exhaust valve 3. The gas intake valves 2 and exhaust valves 3 of a cylinder 8 are controlled by a control apparatus 11 either in a common way or preferably individually.

Figure 2:
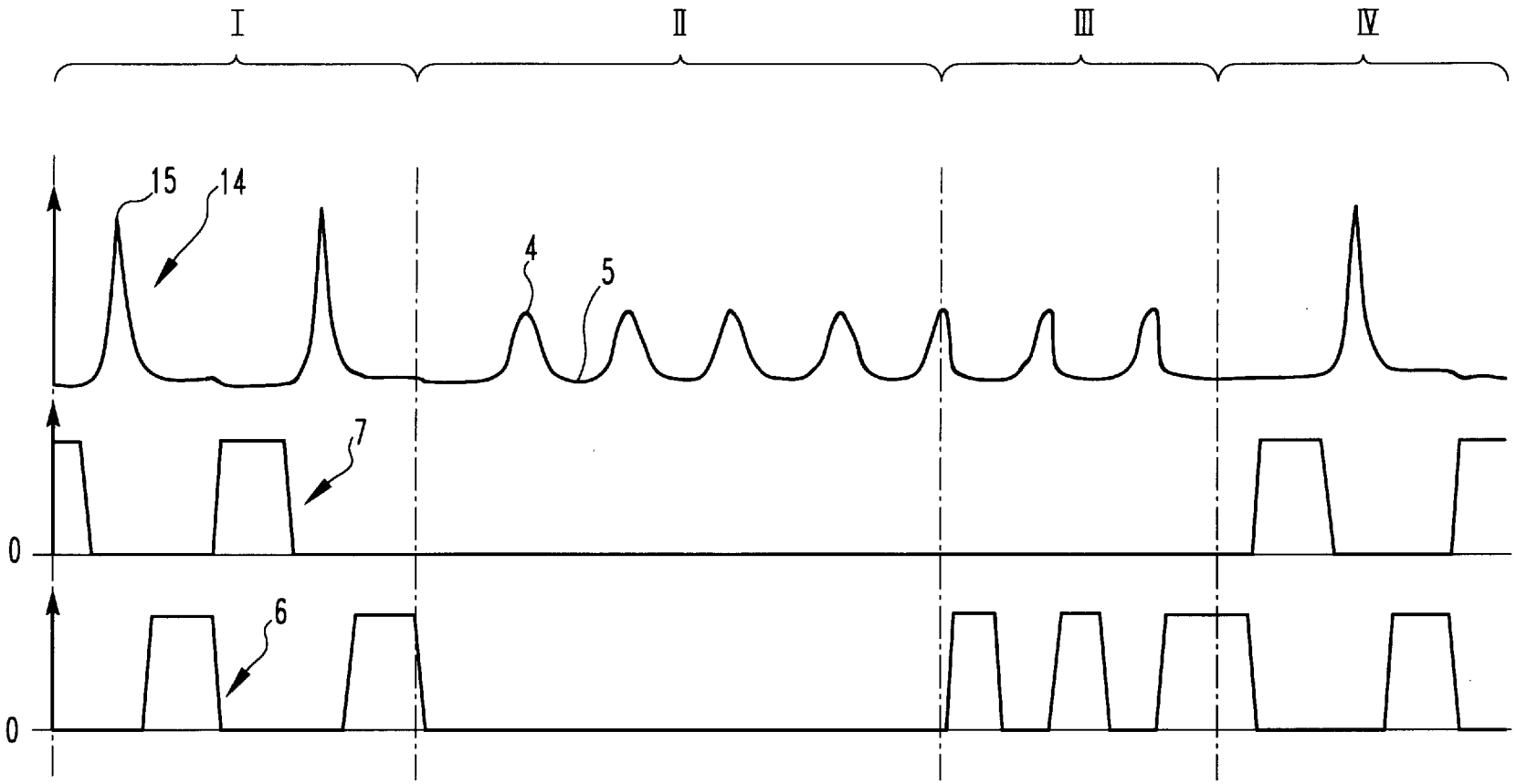
FIG. 2 is a graph showing the cylinder pressure in comparison with opening times of intake and exhaust valves.

FIG. 2 is a graphic representation of the cylinder pressure 14 and in synchronization therewith, the opening times 7 of the gas intake valves 2 and the opening times 6 of the exhaust valves 3 over four operating phases wherein phase IV corresponds essentially to phase I. Phase I relates to the normal vehicle operation with activated fuel injection and ignition and shows pressure peaks 15 at ignition in the cylinder 8.

If, during phase I, above a threshold speed within the idle speed range of the engine as determined by a speed sensor 13, a driver 12 reduces the power requirements for the engine 1 back to idle power by releasing the gas pedal 10, the control unit 11 recognizes that the engine is in a driven mode and the fuel supply can be switched off. Preferably, the driven mode of the engine 1 is activated by the control unit 11 depending on the engine temperature as measured by a temperature sensor 16.

In the engine driven mode, the intake valves 2 and the exhaust valves 3 of all the cylinders 8 are immediately kept closed, that is, after completion of the instant intake or combustion cycle at the end of the following exhaust stroke. At the same time as the intake valves 2 are kept closed, the fuel injection and ignition are interrupted. This is apparent in FIG. 2 at the transition from phase I to phase II.

When all the intake valves 2 and the exhaust valves 3 are closed, there is no air flow through the cylinders 8. Only the enclosed air volume is compressed and expanded, wherein the volume change energy remains constant except for thermal losses. The ignition pressure 15 in the top dead center is reduced to the compression pressure 4, because there is no ignition. The engine braking torque is determined mainly by the mechanical friction of the crank drive and the auxiliary equipment. The kinetic energy of the vehicle is only slightly reduced although the drive line is not disconnected by a clutch such as a coasting clutch.

An increased engine braking torque and, consequently, an effective engine braking operation can be initiated and controlled depending on various vehicle operating parameters, for example, engine speed, vehicle speed, inclination of the vehicle, etc. In accordance with the invention, additionally a reduced power output requirement gradient and/or a brake signal 9 are determined. The reduced power output requirement gradient can be detected at the gas pedal 10, a fuel injection device or another suitable point of the internal combustion engine 1. The brake signal 9 can be determined in a binary fashion in proportion to travel or pressure at the brake pedal or another suitable point in the brake system. It may also be determined at the brake light. The load reducing gradient and the signals 9 from the brake system provide accurate values for controlling the engine braking torque at an early stage. The described parameters can be utilized individually, or in combination for initiating and controlling the engine braking torque.

In accordance with the invention, the engine braking torque is increased by converting the compression and/or expansion energy of the engine 1 into heat utilizing the engine intake valves 2 and exhaust valves 3.

If engine braking operation is initiated as it is shown in FIG. 2 at the transition from phase II to phase III, one of the intake valves 2, or preferably, the exhaust valves 3 are reactivated while the other types of valves 2, 3 remain closed. The opening of the exhaust valve 3 of a cylinder 8, for example, is initiated in the area of the top dead center position of a respective piston. Preferably, the exhaust valve 3 is opened shortly before the piston reaches the top dead center position so that the valve—considering a certain delay—is open when the compression pressure would normally be at its maximum value. In order to adjust the engine braking torque, the valve opening and closing times can be varied around the top dead center area.

The valve is preferably closed shortly before the piston reaches the bottom dead center position wherein there is a gas pressure 5 depending on the pressure in the exhaust system. During the following compression stroke, the gas in the cylinder is compressed. Upon reaching the top dead center position, the exhaust valve 3 is again opened whereby the compression pressure 4 is suddenly released so that the compression energy is converted into heat. The engine braking torque is increased thereby. This process occurs once with every turn of the crankshaft of 360°.

It is also possible to open the exhaust valves only shortly at the upper and lower dead center positions of the pistons that is, to close the valves again shortly after they have been opened.

In that case, the compression as well as the expansion energy is converted into heat whereby the engine braking torque is further increased.

The engine braking torque can be adjusted to braking requirements if, in accordance with the invention, the intake or exhaust valves 2, 3 remain closed during selected, or a series of selected, crankshaft revolutions of the engine 1 and/or this is done for selected ones or all of the cylinders of the engine 1 if the engine is a multi-cylinder engine.

If the control unit 11 receives a signal indicating the end of engine braking operation such as the interruption of a braking signal 9 or an engine speed signal indicating that the engine speed has fallen below a certain threshold, or a power demand signal has been received, the exhaust valves 3 are no longer closed in the bottom dead center position of the piston, but only at the top dead center position thereof in order to remove all of any detrimental remaining gases out of the cylinders 8 for subsequently initiating a normal combustion cycle. Then the gas intake valves with fuel injection and ignition are activated in the normal order of the combustion cycles of the various cylinders for engine power generation (see FIG. 2, phase III to phase IV).

What is claimed is:

1. An internal combustion engine for motor vehicles with an engine shut off driven capability, said engine having intake and exhaust valves with a variable timing valve actuating system permitting the generation of an engine braking torque depending on the vehicle operating state by controlling the intake and exhaust valves, said intake and exhaust valves being controlled during engine braking operation such that at least one type of valves, that is, either all of said intake or all of said exhaust valves remain closed and that, at the end of engine braking operation or when the engine speed has fallen below a certain threshold value, said exhaust valves are opened at the bottom dead center position and remain open during the following exhaust stroke thereby to remove any detrimental gases from said cylinders before the subsequent initiation of a normal combustion cycle.

2. An internal combustion engine according to claim 1, wherein the other type of valves that is the exhaust, or respectively, intake valves are opened at top dead center of a piston movement in the respective cylinders and are closed at the bottom dead center of the piston movement while the one type of valves remain closed.

3. An internal combustion engine according to claim 1, wherein the other type of valves are shortly opened at the top and bottom dead centers of piston movement and are then immediately closed again.

4. An internal combustion engine according to claim 1, wherein, during engine shutoff driven operation, all the valves of at least one of the cylinders of said engine remain closed.

5. An internal combustion engine according to claim 1, wherein said valves are actuated only every second or $n^{th}$ crankshaft revolution depending on the engine braking requirements.

6. An internal combustion engine according to claim 1, wherein during engine braking operation, engine braking torque is controlled on the basis of a load demand reduction gradient.

7. An internal combustion engine according to claim 1, wherein, during engine braking operation, engine braking torque is controlled on the basis of a brake actuation signal.

8. An internal combustion engine according to claim 1, wherein, upon receipt of a load demand signal, the respective exhaust valves are opened such that any gas in a cylinder is discharged before power operation of the engine is resumed.

* * * * *